US008770001B2

(12) United States Patent
David

(10) Patent No.: US 8,770,001 B2
(45) Date of Patent: Jul. 8, 2014

(54) REMOTE CONTROL DEVICE WITH STOWABLE KEY, IN PARTICULAR FOR AN AUTOMOBILE

(75) Inventor: Marc David, Creteil Cedex (FR)

(73) Assignee: Valeo Securite Habitacle, Creteil (FR)

( * ) Notice: Subject to any disclaimer, the term of this patent is extended or adjusted under 35 U.S.C. 154(b) by 367 days.

(21) Appl. No.: 13/060,735

(22) PCT Filed: Aug. 28, 2009

(86) PCT No.: PCT/EP2009/061168

§ 371 (c)(1),
(2), (4) Date: Apr. 8, 2011

(87) PCT Pub. No.: WO2010/023293

PCT Pub. Date: Mar. 4, 2010

(65) Prior Publication Data

US 2011/0179838 A1 Jul. 28, 2011

(30) Foreign Application Priority Data

Sep. 1, 2008 (FR) ..... 08 55835
Dec. 10, 2008 (FR) ..... 08 06917

(51) Int. Cl.
*A44B 15/00* (2006.01)

(52) U.S. Cl.
USPC ..... 70/456 R; 70/408

(58) Field of Classification Search
USPC ..... 70/408, 456 R, 459
See application file for complete search history.

(56) References Cited

U.S. PATENT DOCUMENTS

| | | | | |
|---|---|---|---|---|
| 6,499,326 | B1 * | 12/2002 | Heussner | 70/399 |
| 6,705,141 | B1 * | 3/2004 | Jacob et al. | 70/408 |
| 7,055,352 | B2 * | 6/2006 | Meyerson et al. | 70/456 R |
| 7,370,501 | B2 * | 5/2008 | Miyata et al. | 70/395 |
| 8,225,633 | B2 * | 7/2012 | Luo et al. | 70/456 R |
| 8,266,936 | B2 * | 9/2012 | Box et al. | 70/408 |
| 8,479,546 | B2 * | 7/2013 | Delande et al. | 70/456 R |
| 2005/0103070 | A1 | 5/2005 | Meyerson et al. | |
| 2007/0062229 | A1 | 3/2007 | Miyata et al. | |

FOREIGN PATENT DOCUMENTS

| | | | |
|---|---|---|---|
| DE | 10 2006 036503 | A1 | 2/2008 |
| EP | 1 609 931 | A1 | 12/2005 |

OTHER PUBLICATIONS

International Search Report w/translation from PCT/EP2009/061168 dated Oct. 22, 2009 (4 pages).

* cited by examiner

*Primary Examiner* — Suzanne Barrett
(74) *Attorney, Agent, or Firm* — Osha Liang LLP

(57) ABSTRACT

The invention relates to a remote control device with a stowable key, in particular for an automobile, which comprises a remote control casing including two lower (1) and upper (2) shells, an insert (3) defining a key-bit pivotally mounted between an extended use position and a stowed position inside the casing, and an elastic return mechanism for returning the insert to the extended position, which comprises a push button (4) provided on the upper shell (2). According to the invention, the insert (3) rotates directly about said button (4) which is rotatingly connected with the upper shell (2), and includes rotational indexing means with said insert (3) that can be declutched by pushing said button (4).

10 Claims, 5 Drawing Sheets

REMOTE CONTROL DEVICE WITH STOWABLE KEY, IN PARTICULAR FOR AN AUTOMOBILE

The invention relates to a remote control device with a retractable key, particularly for a motor vehicle.

Such a key comprises a remote control unit comprising two shells, a lower one and an upper one, an insert forming a key bit mounted so that it can pivot about an axis between a deployed position of use and a retracted position stowed inside the unit and an elastic return mechanism for returning the insert towards the deployed position comprising a push-button of circular cylindrical shape situated on the so-called upper shell.

EP 1 609 931 discloses how to produce an element in the form of a bell housing comprising an indexing means capable of collaborating with a corresponding indexing means belonging to the lowest shell, so as to preload a spring after an ejection mechanism comprising the button has been mounted inside the unit. The operating button itself is mounted on top of this bell housing on a pivot pin snap-fastened onto the lower shell and, being completely independent, experiences no force as the insert deploys.

This type of push-button does not therefore turn as the insert deploys, unlike in other embodiments in which the button is secured in terms of rotation to the insert and turns with it from the deployed position into the retracted stowed position and vice versa. In the latter instances, the insert may be braked by the action or friction of the driver's digit on the button while he is pressing it to deploy.

However, the embodiment described in patent document EP 1 609 931 is, on the one hand, of a relatively complex make up with a high number of component parts to be fitted, the pivot pin, the bell housing and the button itself.

On the other hand, it has been found that the flexural rigidity of the insert, in the deployed position, is insufficient because the indexing of the bell housing to the lower shell is performed over a relatively small surface area. However, motor manufacturers may demand good flexural rigidity.

The invention addresses these problems by proposing a remote control device with retractable key, particularly for a motor vehicle, that has a better flexural rigidity of insert, in the deployed position, and is of a particularly simple makeup, while at the same time keeping a button which does not rotate as the insert moves.

To achieve this, the invention proposes a remote control device with retractable key, particularly for a motor vehicle, comprising a remote control unit comprising two shells, a lower one and an upper one, an insert forming a key bit mounted so that it can pivot between a deployed position of use and a retracted position stowed inside the unit and an elastic return mechanism for returning the insert towards the deployed position comprising a push-button arranged on the so-called upper shell, the device being characterized in that said insert turns directly about said button which is secured in terms of rotation to the upper shell and comprises means of indexing rotation with said insert which means can be disengaged by pressing said button.

The button acts as the pivot pin for the insert, which means that there are a minimal number of component parts needed to make up the elastic return mechanism.

In fact, there are two of such parts, the button and a return spring.

This button is secured in terms of rotation to the upper shell which means that relatively large contact areas can be achieved, even when the insert is in the deployed position. This gives the insert better flexural rigidity in the deployed position.

As the button is unable to rotate, the occupied volume that would be occupied by a rotation is then used for mechanical strength.

Moreover, the visible end of the button can be of any shape, for example ovoid or parallelepipedal.

According to one preferred embodiment, said button is secured in terms of rotation to the upper shell by means of several first radial tenons which nest in corresponding first cavities of the upper shell.

For preference, said upper shell has an increase in thickness at the site of said first cavities.

This increase in thickness that can be achieved on the upper shell improves the flexural rigidity of the insert when in the deployed position.

Advantageously, said indexing means consist of at least one second radial tenon nesting in a corresponding second cavity of the insert in the retracted position and which is disengaged through a translational movement as the insert is deployed.

Said second radial tenon may be situated at the lower end of the button.

For preference, said button is of substantially cylindrical shape.

For preference, said elastic return mechanism comprises a helical spring working in torsion and in compression.

Advantageously, said spring is positioned inside said button and acts in compression between the insert and the closed upper end of the button.

Said spring may have its ends prevented from rotating on the insert and on the button.

The invention also relates to a prefabricated module for producing such a remote control device with retractable key, characterized in that it comprises a clevis of said insert, said button and said spring.

The invention is described in greater detail with the aid of figures which depict just some preferred embodiments of the invention.

Figure 1:
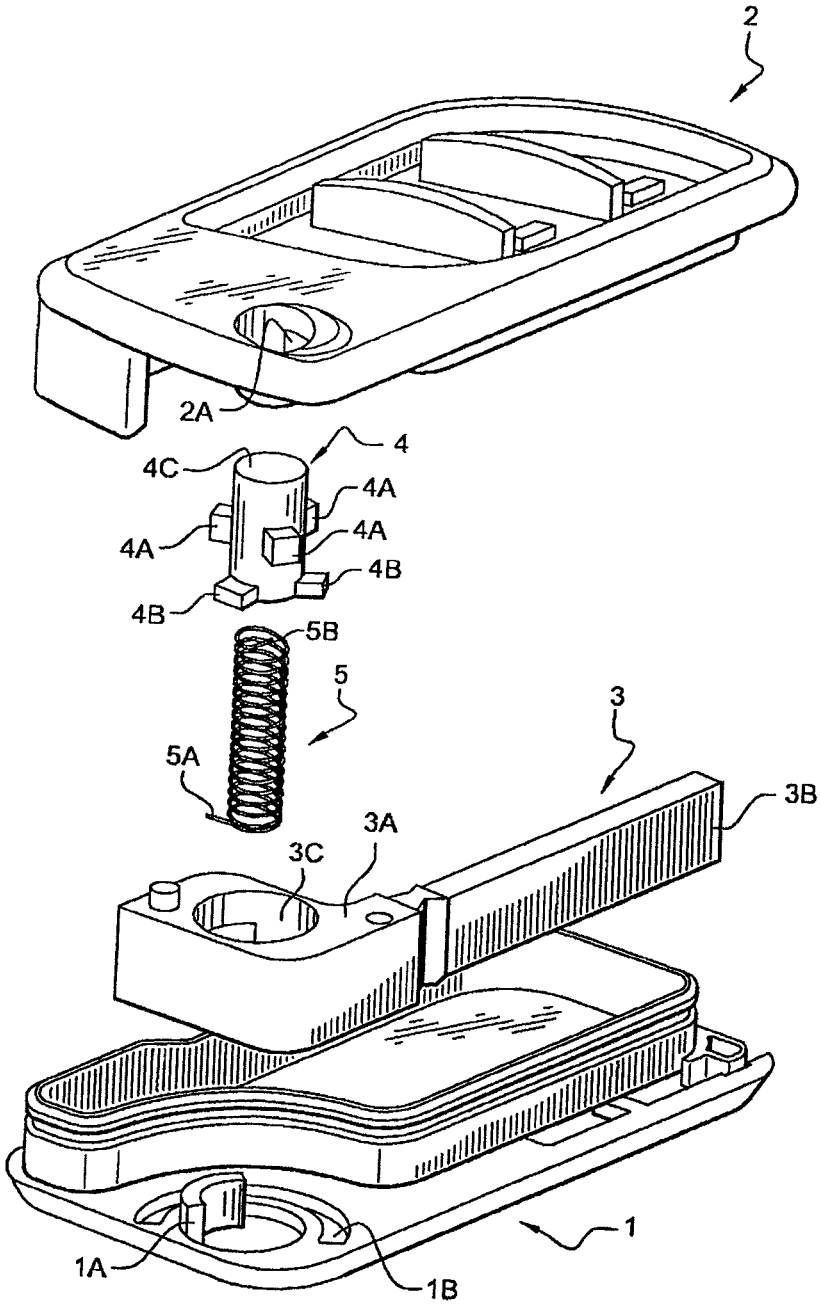
FIG. 1 is an exploded perspective view of a remote control device with retractable key according to the invention.

As FIG. 1 illustrates, the remote control device with retractable key, particularly for a motor vehicle, according to the invention, comprises a remote control unit comprising two shells, a lower one 1 and an upper one 2, an insert 3 forming a key bit mounted so that it can pivot between a deployed position of use and a retracted position stowed inside the unit and an elastic return mechanism for returning the insert towards the deployed position comprising a push-button 4 situated on the upper shell 2.

The unit is intended to house the component parts of the remote control and the upper shell 2 is intended to be fitted with the members for operating the remote control.

The insert 3 consists of a clevis 3A and of the key bit 3B itself, which are joined together by a pin.

The button 4 is of substantially hollow cylindrical shape and is inserted in a bore 3C of the clevis 3A.

The insert 3 or, more precisely, the clevis 3A thereof, is mounted on the button and turns directly about the latter, which is secured in terms of rotation to the upper shell 2 and comprises means of indexing rotation with the clevis 3A, which means can be disengaged by the pressing of the button 4.

Figure 2:
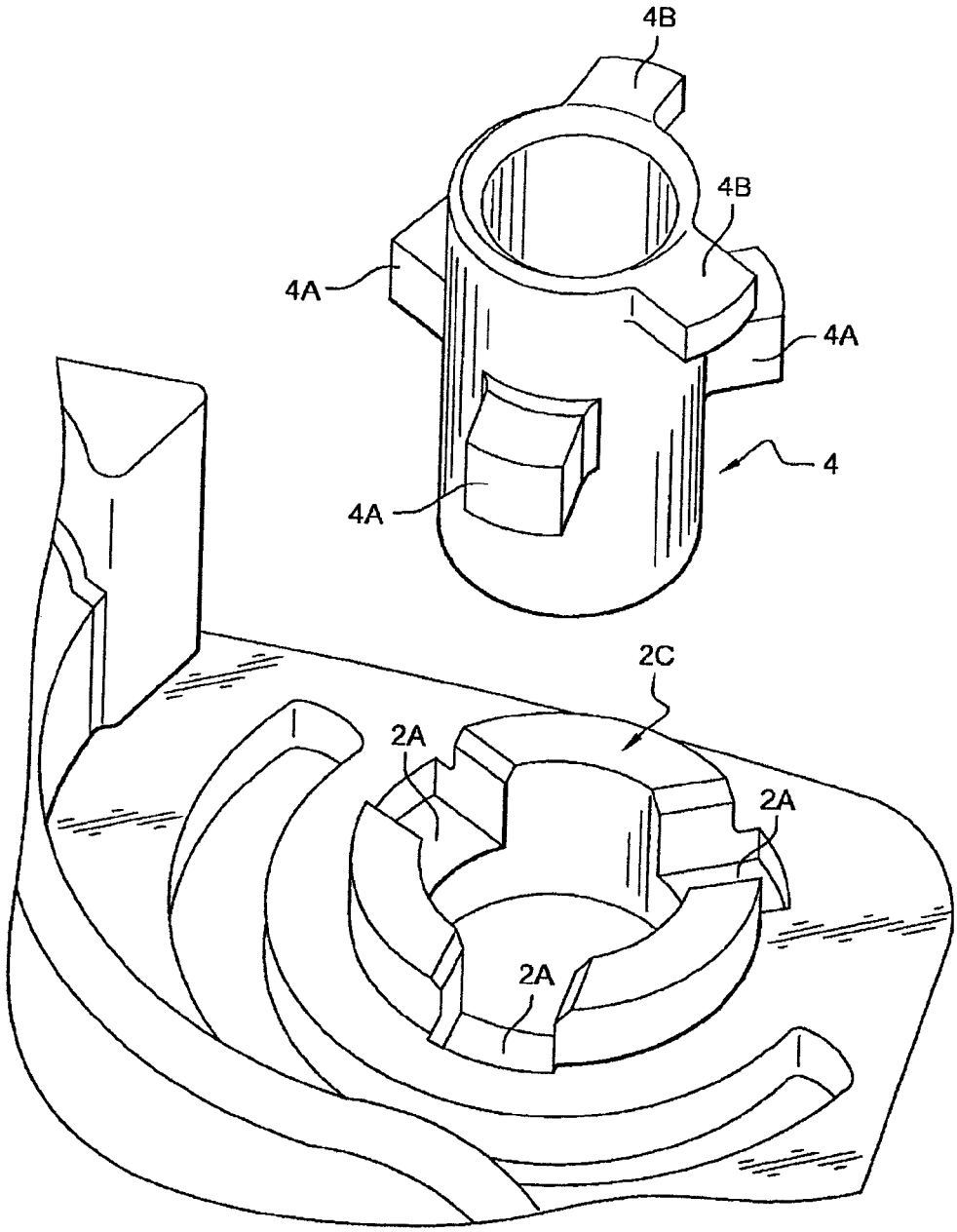
FIG. 2 is an exploded partial perspective view of the upper shell and of the button of a remote control device with retractable key according to the invention.
Figure 3:
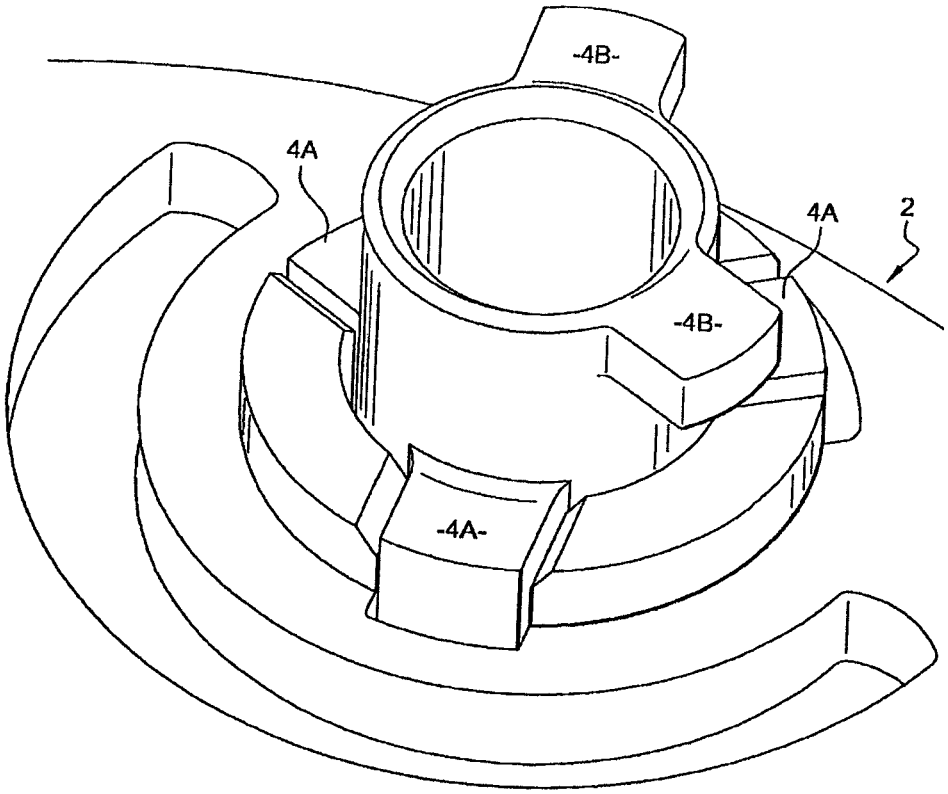
FIG. 3 is a partial perspective view of the upper shell and of the button of a remote control device with retractable key according to the invention.

The button 4 is secured in terms of rotation to the upper shell 2 by means of several first radial tenons 4A, here three of these, which nest in corresponding first cavities 2A of the upper shell 2, as illustrated in FIGS. 2 and 3. The upper shell 2 has an increase in thickness 2C at the site of these first cavities.

The directional concepts of top, bottom, upper and lower as used hereinafter relate to the direction of positioning depicted in FIG. 1.

Figure 4:
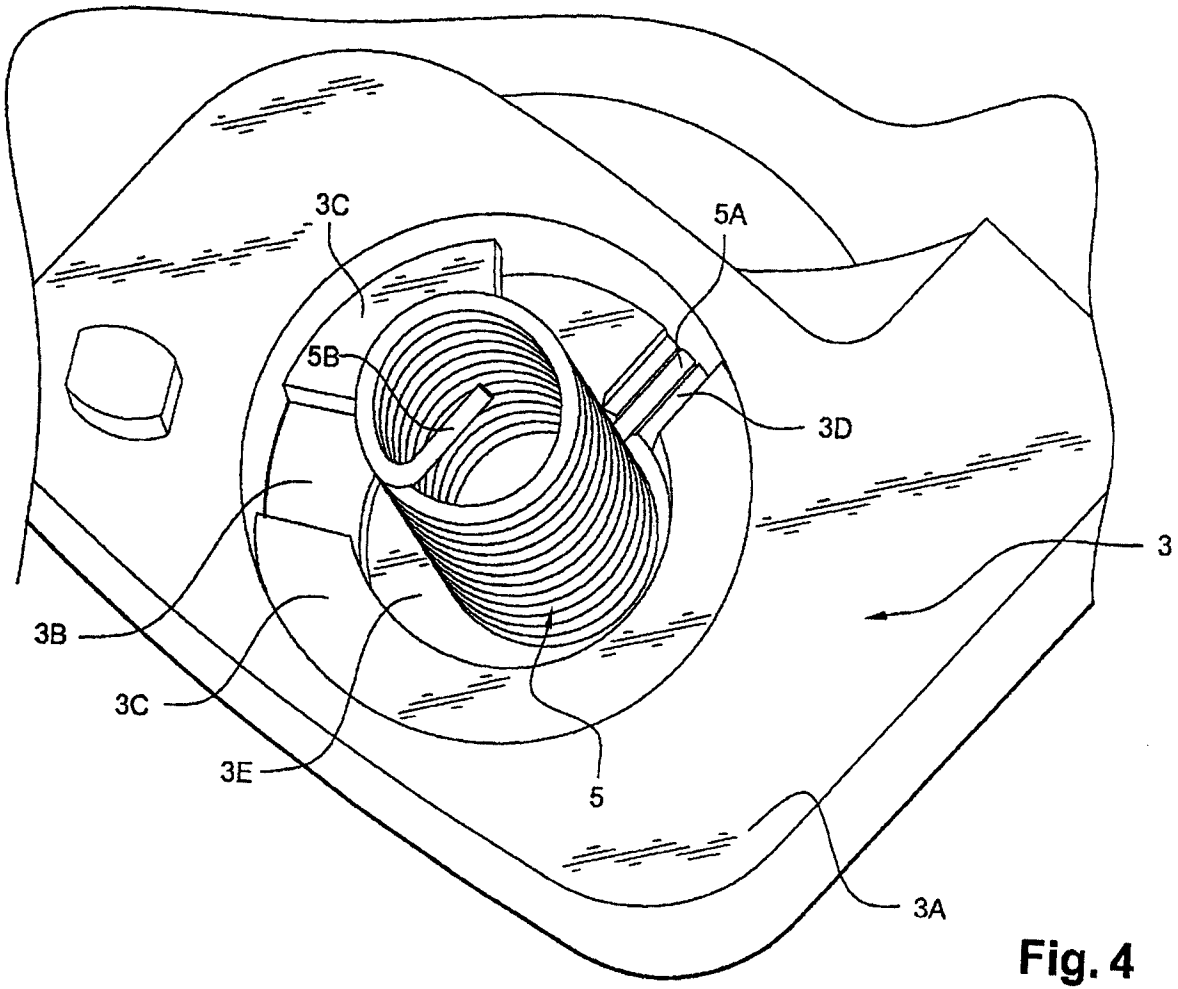
FIG. 4 is a partial perspective view of the insert and of the spring of a remote control device with retractable key according to the invention.
Figure 5:
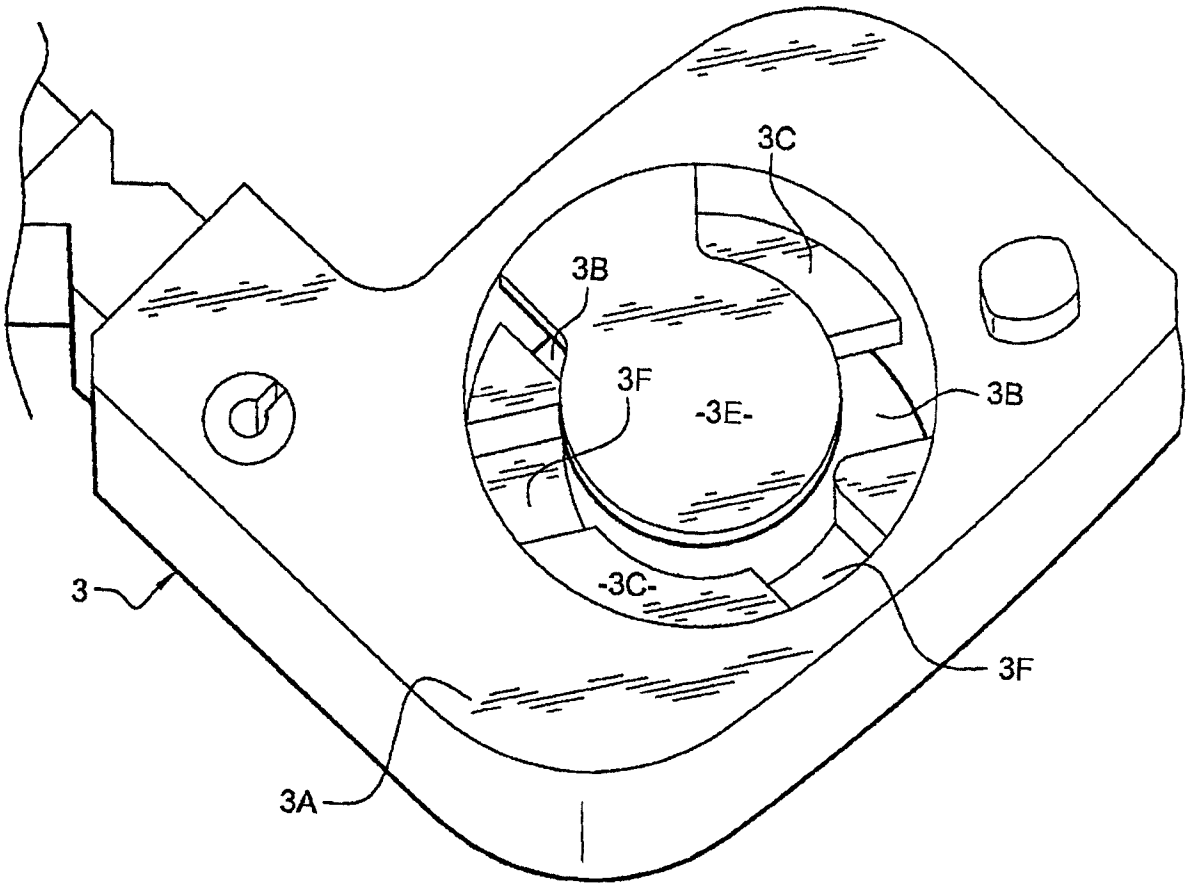
FIG. 5 is a partial perspective view from beneath of the insert of a remote control device with retractable key according to the invention.

The indexing means consist of at least one second radial tenon 4B nesting in a corresponding second cavity of the clevis of the insert in the retracted stowed position and which is disengaged through a downwards translational movement as the insert is deployed. In the embodiment depicted, two such second tenons 4B are provided, together with two such cavities 3B in the clevis 3A which can be seen in FIGS. 4 and 5. These second radial tenons 4B are situated at the lower end of the button 4.

The elastic return mechanism also comprises a helical spring 5 working in torsion and in compression.

This spring 5 is situated inside the button 4 and acts in compression between the clevis 3A of the insert and the closed upper end of the button 4, once the unit has been closed. It therefore, by compression, pushes the button 4 upwards, in a bore 2A of the upper shell, in the rest position.

In this rest position, in which the insert 3 is in the retracted position stowed inside the unit, the second tenons 4B of the button are situated in the second cavities 3B of the clevis 3A of the insert 3 and prevent the rotation of the insert. These through-cavities 3B are in fact formed between radial ribs 3C internal to the bore 3C of the clevis 3A, situated at a corresponding height at the lower end of the button, in this rest position.

The spring 5 has its lower end 5A prevented from rotating on the clevis 3A of the insert, being inserted in a groove 3D arranged in the bottom 3E of this clevis, and has its upper end 5B prevented from rotating in the bottom of the button, on the closed wall 4C thereof. In said rest position, it is thus torsionally preloaded.

To deploy the insert, the driver presses the push-button 4 which therefore effects a downwards translational movement, compressing the spring 5.

Bearing in mind the height of the first tenons 4A and of the increase in thickness 2C, these tenons remain engaged in the first cavities 2A and the button therefore remains prevented from rotating by the connection to the upper shell 2.

The second tenons 4B are moved downwards and reach a level lower down than the ribs 3C of the clevis of the insert, which is then freed to rotate. The spring 5 therefore releases its torsional preload energy and causes this clevis to rotate as far as the deployed position. In this deployed position, the second tenons 4B of the button each face a cavity 3F which is not a through-cavity, arranged under each of the radial ribs 3C. Under the effect of the compression of the spring 5, the button is therefore pushed back up, the second tenons 4B becoming housed in these cavities 3F which are not through-cavities. The insert 3 is therefore once again prevented from rotating with the button which is also prevented from rotating with the upper shell 1B with the first tenons 4A butting against a large area, ensuring good flexural rigidity.

When, later, the driver wishes to retract and stow the insert, he presses the push-button 4 which therefore undergoes a downwards translational movement, compressing the spring 5.

The second tenons 4B are moved downwards, leave the cavities 3F which are not through-cavities and reach a level lower than the ribs 3C of the clevis of the insert, which is then freed to rotate. The insert 3 can therefore be returned manually to the retracted stowed position, the spring 5 then being torsionally preloaded. In this retracted stowed position, the second tenons 4B of the button each face a through-cavity 3B arranged between the radial ribs 3C. Under the effect of the compression of the spring 5, once released, the button is pushed back up, the second tenons 4B becoming housed in the through-cavities 3B. The insert 3 is therefore once again prevented from rotating with the button which is also prevented from rotating with the upper shell 1B.

As it rotates, the clevis 3A is guided by abutment against a rib 1A arranged on the lower shell 1 and by a tenon being guided in a semi-circular groove 1B likewise arranged on the lower shell.

The assembly consisting of the clevis 3A of the insert, of the button 4 and of the spring 5 can be preassembled, with the preloaded spring. The arrangement according to the invention therefore allows such a module to be prefabricated, which module can then be produced and delivered by a supplier to the manufacturer of the remote control device.

The invention claimed is:

1. A remote control device with retractable key for a motor vehicle, comprising:

a remote control unit comprising a lower shell and an upper shell;

an insert forming a key bit mounted so that the insert pivots between a deployed position of use and a retracted position stowed inside the unit;

an elastic return mechanism for returning the insert towards the deployed position comprising a push-button situated on the upper shell; and means of indexing rotation with said insert that is disengaged by pressing said push-button, wherein said insert turns directly about said push-button which is secured in terms of rotation to the upper shell by a plurality of first tenons and a plurality of second tenons that protrude outwardly from said push-button, the first tenons, with respect to the second tenons, are axially elevated and rotated about an axis.

2. The device as claimed in claim 1, wherein said push-button is secured in terms of rotation to the upper shell by the first tenons that nest in corresponding first cavities of the upper shell.

3. The device as claimed in claim 2, wherein said upper shell increases in thickness at the site of said first cavities.

4. The device as claimed in claim 1 wherein said indexing means comprise the second tenons nesting in a corresponding second cavity of the insert in the retracted stowed position and which is disengaged through a translational movement as the insert is deployed.

5. The device as claimed in claim 4, wherein said second tenons are situated at the lower end of the push-button.

6. The device as claimed in claim 1 wherein said push-button is of substantially cylindrical shape.

7. The device as claimed in claim 1 wherein said elastic return mechanism comprises a helical spring working in torsion and in compression.

8. The device as claimed in claim 7, wherein said spring is situated inside said push-button and acts in compression between the insert and the closed upper end of the push-button.

9. The device as claimed in claim 8, wherein said spring has ends prevented from rotating on the insert and on the push-button.

10. A production module comprising:

a prefabricated module for producing a remote control device with retractable key, the remote control device, comprising:

a remote control unit comprising a lower shell and an upper shell;

an insert forming a key bit mounted so that the insert pivots between a deployed position of use and a retracted position stowed inside the unit;

an elastic return mechanism for returning the insert towards the deployed position comprising a push-button situated on the upper shell, said insert turns directly about said push-button which is secured in terms of rotation to the upper shell; and means of indexing rotation with said insert that is disengaged by pressing said push-button, wherein said elastic return mechanism comprises a helical spring working in torsion and in compression, and wherein the module comprises a clevis of said insert, said button and said spring.

* * * * *